United States Patent [19]

Barniak

[11] 4,437,576

[45] Mar. 20, 1984

[54] DRINKING VESSEL WITH SELF-CONTAINED STRAWS

[76] Inventor: Richard L. Barniak, Morgan Gulf Rd., Turin, N.Y. 13473

[21] Appl. No.: 429,385

[22] Filed: Sep. 30, 1982

[51] Int. Cl.[3] ..... B65D 41/26; B65D 25/38; B65D 8/02

[52] U.S. Cl. ..... 220/90.4; 220/90.2; 222/548; 229/7 R; 229/7 S

[58] Field of Search ..... 220/90.2, 90.4, 253; 229/7 S, 7 R; 215/1 A; 222/548

[56] References Cited

U.S. PATENT DOCUMENTS

| | | | |
|---|---|---|---|
| 1,340,886 | 5/1920 | Galleguillos | 220/90.4 X |
| 2,263,947 | 11/1941 | Gottfried | 220/90.2 |
| 2,885,134 | 5/1959 | Cohen | 229/7 S X |
| 2,914,214 | 11/1959 | Messinger | 220/90.4 |
| 2,948,453 | 8/1960 | Drown | 220/90.4 X |
| 3,042,273 | 7/1962 | Bauer et al. | 222/548 |
| 3,058,630 | 10/1962 | Abt | 222/548 X |
| 3,093,272 | 6/1963 | Esthus | 222/548 X |
| 3,463,364 | 8/1969 | Rehag | 222/548 X |
| 3,558,033 | 1/1971 | Leeds | 229/7 S |
| 3,773,243 | 11/1973 | Greene | 229/7 S |
| 3,921,889 | 11/1975 | Gibbons | 220/90.2 X |
| 4,098,439 | 7/1978 | Blow, Jr. et al. | 222/548 |
| 4,190,173 | 2/1980 | Mason et al. | 222/548 |
| 4,299,339 | 11/1981 | Giroux et al. | 222/548 X |
| 4,308,979 | 1/1982 | Otterson | 220/253 X |

*Primary Examiner*—Allan N. Shoap
*Attorney, Agent, or Firm*—Charles S. McGuire

[57] ABSTRACT

A drinking cup, preferably of the disposable type, for hot or cold beverages having conduit means extending through or along a side wall thereof between open upper and lower ends positioned at the cup lip and lower interior, respectively. A lid is provided for sealing engagement with the cup lip and includes an opening which may be positioned either in or out of registration with the upper end of the conduit means, in accordance with the selective rotational orientation of the lid upon the lip. Preferably, a plurality of separate conduit means are provided in side-by-side relation, the size of the lid opening permitting selective registration with the upper ends of any desired number of the conduit means.

5 Claims, 9 Drawing Figures

DRINKING VESSEL WITH SELF-CONTAINED STRAWS

BACKGROUND OF THE INVENTION

The present invention relates to drinking vessels with removable covers, and more specifically to disposable cups, or the like, having novel means in the nature of self-contained straws through which a beverage may be withdrawn.

It is a widespread current practice to dispense hot and cold beverages in disposable cups having a removable cover placed over the lip at the upper end of the cup, the configuration and materials of the cup and cover providing a substantially sealed relationship. The beverage, at least in the case of cold beverages, is withdrawn through a common drinking straw which is inserted into the cup through an opening such as X-cut slits in the cover. The use of such beverage dispensing units, i.e., cups, mating covers, and straws, provides a relatively inexpensive and convenient means of dispensing bulk beverages, with literally millions used each day for cold beverages alone. The use of drinking straws for hot beverages is much less common, due at least in part to the possibility of burning the mouth by drawing a hot beverage through the relatively concentrated area of a drinking straw.

Although the cup, when securely mated on the cup lip, is a deterrent to leakage or spillage should the cup be tipped or overturned, leakage may occur through and around the straw. In fact, the presence of the straw, extending for a substantial distance upwardly from the cup, creates an additional means of inadvertent overturning and adds to the possibility of dislodging the cap.

It is a principal object of the present invention to provide a drinking vessel providing all the convenience of a sealable cover with beverage withdrawal through a drinking straw, while eliminating the straw as a separate element.

A further object is to provide a beverage cup and mating lid combination which allows withdrawal of the beverage in a number of selected increments.

An additional object is to provide a drinking cup having built-in straw means having a lower end with which the liquid contents self-align when the cup is tipped, permitting easy withdrawal of all liquid.

Another object is to provide a disposable, molded plastic drinking cup having built-in beverage withdrawal means which can be manufactured at a cost not significantly greater than a cup of similar size without such means.

Still another object is to provide stackable beverage cups with self-contained drinking straw means which are configured to facilitate withdrawal of individual cups from a stack of such cups placed one within the other.

Other objects will in parts be obvious and will in part appear hereinafter.

SUMMARY OF THE INVENTION

In accordance with the foregoing objects, the invention contemplates a drinking cup having the usual bottom wall and generally cylindrical side wall terminating in a circular lip, and a mating cover with a surrounding grooved flange which may be placed in mating engagement with the lip to form a substantially sealed covering. The cup incorporates conduit means, preferably a plurality of adjacent passageways extending along the side wall between open upper and lower ends at the cup lip and bottom wall. The cover includes an opening in the flange area which may be selectively placed in registration with one or more of the upper ends of the conduit means for withdrawal of the beverage, or out of registration therewith to provide an essentially sealed container.

The invention is disclosed in two embodiments. In the first, the cup is formed as a monolithic, molded article, and in the second it is assembled from two initially separate parts of a material such as waxed or plastic-coated paperboard. The construction of the cover element may remain the same in both embodiments.

DETAILED DESCRIPTION

Figure 1:
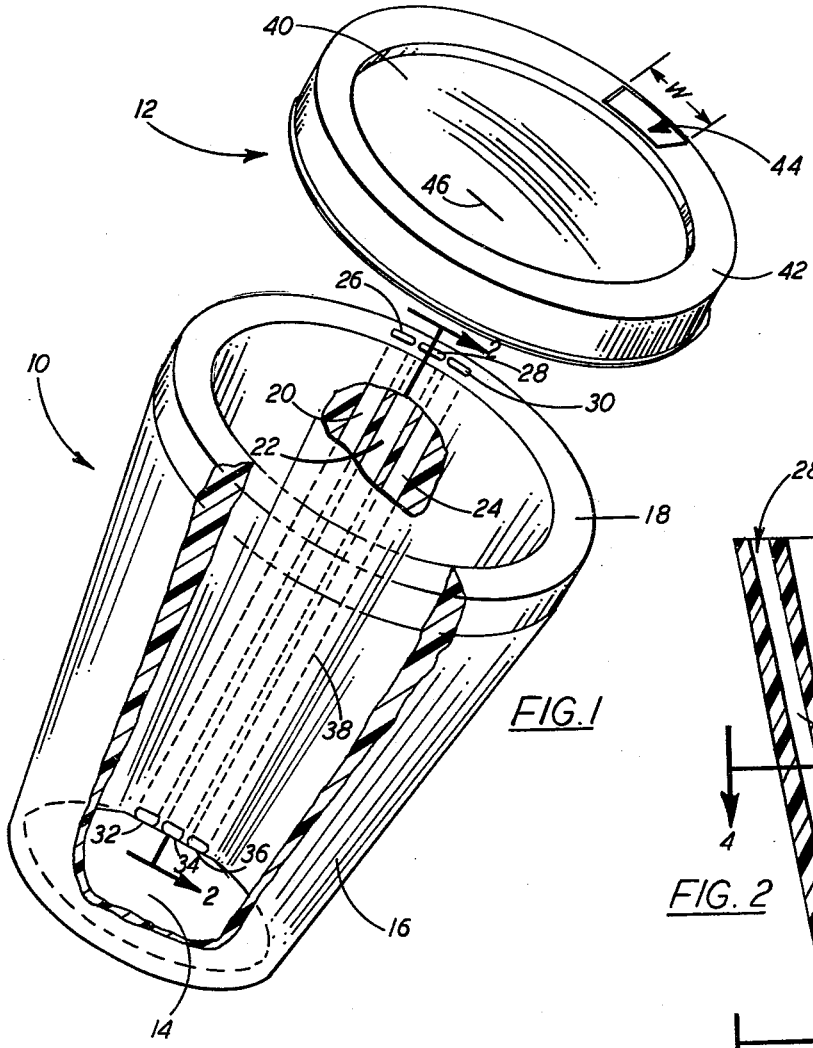
FIG. 1 is a perspective view, with portions broken away, of the preferred embodiment of the drinking cup of the invention, with mating cover.
Figure 2:
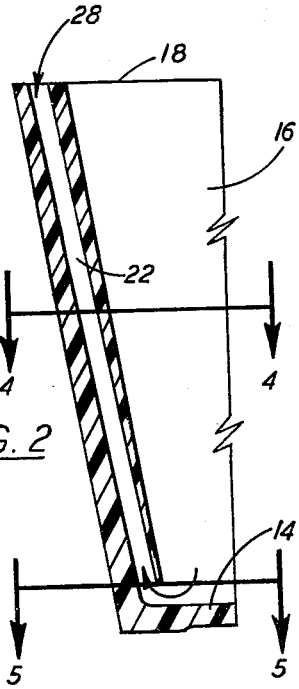
FIg. 2 is a side elevational view of a portion of the cup of FIG. 1, in section on the line 2—2 thereof.

Referring now to the drawings, in FIGS. 1–5 is shown a first, preferred embodiment of the invention including a drinking vessel or cup and mating lid therefor, the cup and lid being generally denoted by reference numerals 10 and 12, respectively. Cup 10 comprises the usual, circular bottom wall 14 and generally cylindrical side wall 16, the particular configuration shown tapering outwardly toward the top. Side wall 16 terminates in circular lip 18 which has a flat, planar upper surface in the illustrated form, but which may be curved or of other desired cross sectional shape. Cup 10 may conveniently and economically be formed of a suitable plastic, such as expanded polystyrene, by conventional molding techniques.

At least one, but preferably a plurality of individual passageways extend through side wall 16 from lip 18 to, or near, bottom wall 14, to provide conduit means through which a beverage may be withdrawn from cup 10 in the manner of a drinking straw. In the embodiment of FIGS. 1–5, three such passageways, numbered 20, 22 and 24, are provided in side-by-side, parallel relation. Passageways 20, 22 and 24 extend from open, upper ends 26, 28 and 30, respectively, on lip 18, to open, lower ends 32, 34 and 36, respectively, adjacent bollom wall 14.

Although subject to variations in design, side wall 16 diminishes in cross section from lip 18 to bottom wall 14 in areas other than those through which passageways 20, 22 and 24 extend. As is apparent, for example, from FIG. 2, the total thickness of wall 16 at the lower ends of the passageways is substantially the same as the thickness at lip 18. This provides a portion of increased thickness, indicated in FIGS. 1 and 4 by reference numeral 38, in the area of side wall 16 below lip 18 through which the passageways extend. When a number of cups 10 are stacked with the bottom of one cup extending into the top of the next, the cylindrical outer surfaces engage the irregular inner surfaces, providing some air space between the nested cups, tending to prevent them from becoming wedged or stuck together. This is of greatest importance in applications where beverages are dispensed in rapid sequence and time lost in attempting to remove a cup which is stuck inside another is economically significant. It is important to note, however, that the area of irregular inner cross section is below the lip which is entirely symmetrical about its entire periphery to insure sealing engagement therewith of the lid in any rotational orientation.

Lid 12 is designed for use with cup 10, having central portion 40 for covering the top of the cup and peripheral flange 42, defining a groove for mating engagement with lip 18. Such mating cup and lid combinations are in common use, the configurations and materials being such that some degree of resiliency is provided, and the cup is substantially sealed by forcing the lid groove upon the cup lip. Although conventional in all other respects, lid 12 includes opening 44 in a portion of flange 42. The width of opening 44, denoted in FIG. 1 by the letter w, is at least great enough that the opening will simultaneously cover all of upper ends 26, 28 and 30 of passageways 20, 22 and 24 when lid 12 is placed in this rotational orientation upon lip 18.

Figure 3:
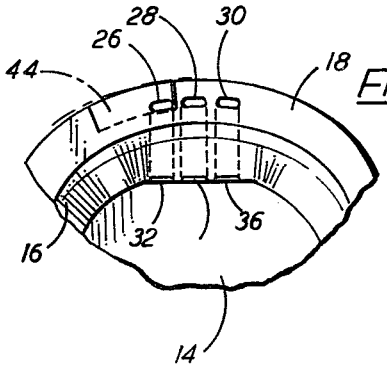
FIG. 3 is a fragmentary, plan view of a portion of the cup of FIG. 1.
Figure 4:
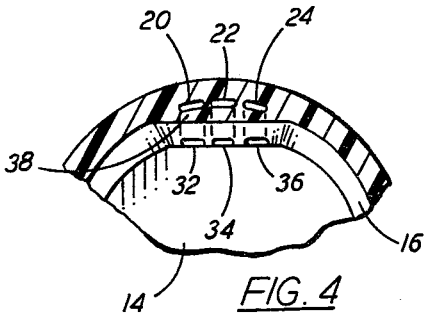
FIGS. 4 and 5 are fragmentary, plan views in section on the lines 4—4 and 5—5, respectively, of FIG. 2.
Figure 5:
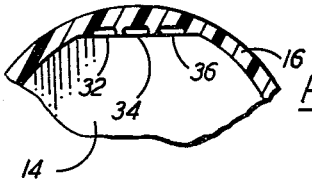
Figure 6:
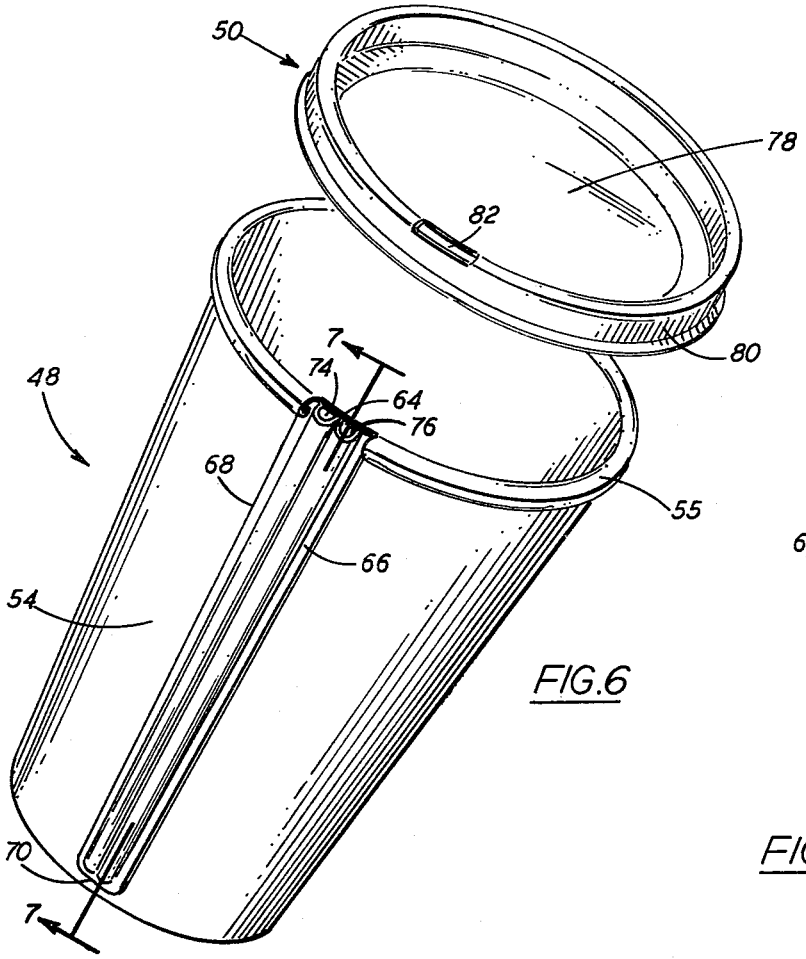
FIG. 6 is a perspective view of a second embodiment of the invention.
Figure 7:
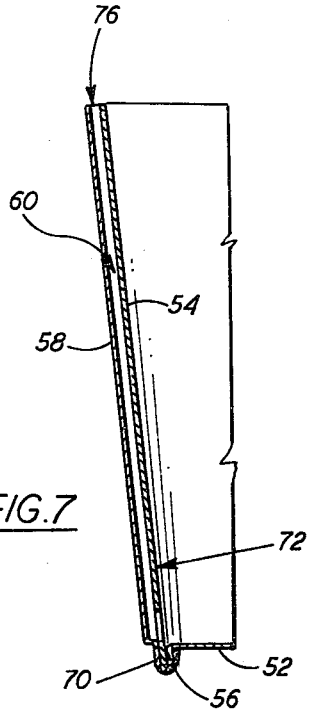
FIG. 7 is a side elevational view of a portion of the cup of FIG. 6, in section on the line 7—7 thereof.
Figure 8:
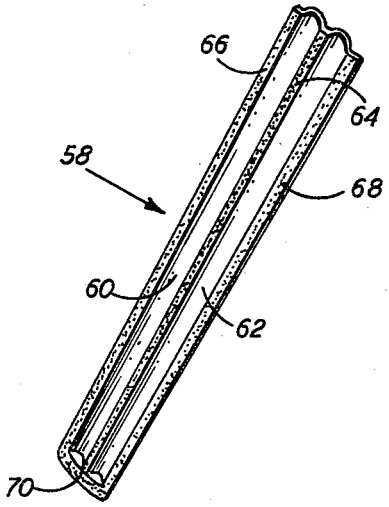
FIG. 8 is a perspective view of an element of the cup of FIG. 6.
Figure 9:
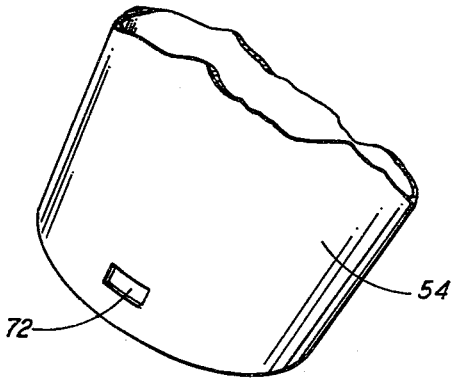
FIG. 9 is a fragmentary, perspective view of a lower portion of the cup of FIG. 6 prior to assembly therewith of the element of FIG. 8.

Since both lip 18 and flange 42 are symmetrical about their entire peripheries, they may be placed in any desired relative rotational orientation. When lid 12 is placed in mating engagement with lip 18 with opening 44 covering a solid portion of the lip, i.e., if the lid opening is not in registration with any portion of the lip which incorporates upper ends 26, 28 and 30 of passageways 20, 22 and 24 the lid effectively seals the contents of the cup in the usual manner of such cup-lid combinations, the upper ends of the passageways being in the plane of the lip and therefore contacted and sealed by flange 42 in the same way as the rest of the lip. When lid 12 is engaged in a position where opening 44 is in registration with one of the passageway upper ends, such as indicated in FIG. 3 where opening 44 is in registration only with upper end 26, a beverage within cup 10 may be withdrawn through the associated passageway (20) in the manner of a drinking straw. When it is desired to withdraw the beverage at a faster rate, lid 12 may be engaged with lip 22 in such rotational orientation that opening 44 is in registration with two, or all three, of upper ends 26, 28 and 30 of the passageways. Slit 46, or other such means, may be formed in cover portion 40 of lid 12, if desired, to allow air to enter cup 10 as beverage is withdrawn therefrom without substantially effecting the seal provided by the lid.

Turning now to FIGS. 6–9, the invention is shown in another embodiment of combined cup 48 and lid 50, which may be employed in situations where it is preferred that the cup be fabricated in a form other than a unitary, molded item. Cup 48 again includes bottom wall 52 and generally cylindrical side wall 54, bounded by symmetrical lip 55. The cup may be formed by conventional fabrication techniques from paperboard, or similar materials, provided with a suitable, liquid-impervious coating which also forms an effective seal when bottom wall 52 is configured with downwardly extending, peripheral lip 56 to which side wall 54 is attached.

Element 58 is formed of the same material with a pair of parallel grooves 60 and 62 separated by medial portion 64 and having flange portions 66 and 68 on the outer sides thereof. Lower flange portion 70 provides a closed lower end for grooves 60 and 62 when element 58 is reversed from the position shown in FIG. 8 and attached, by heat sealing, glue, etc., to the outside surface of side wall 54.

Opening 72 is cut in side wall 54 just above bottom wall 52, and element 58 is attached to side wall 54 with the lower ends of both grooves 60 and 62 in registration with opening 72. Lip 55, which may be formed as a rolled-over portion of side wall 54 is interrupted to expose the open, upper ends 74 and 76 of grooves 60 and 62. Lip 50 is formed, with central cover portion 78 and surrounding flange 80 which mates in substantially sealing engagement with lip 55. Opening 82 in flange 80 may be placed in registration with one or both openings 74 and 76, or with an uninterrupted portion of lip 55 when the cup is to be completely sealed. The peripheries of openings 74 and 76 are in the plane of lip 55 so that they are contacted and closed by flange 80 when lid 50 is so oriented. Beverage may be withdrawn in the manner of drinking straws from cup 48 through one of both of grooves 74 and 76, as determined by the rotational orientation of lid 50, which communicate with the interior of the cup through opening 72 in the area of bottom wall 52.

What is claimed is:

1. A drinking vessel comprising, in combination:

(a) liquid container means having a bottom wall and a side wall extending from said bottom wall to an open end defined by a circular lip having a constant, symmetrical width about its entire periphery;

(b) conduit means extending through said side wall between an open lower end communicating with the interior of said container means in the area of said bottom wall and an open upper end in the area of said lip; and (c) cover means having a circular, symmetrical flange portion adapted for frictional, releasable sealing engagement with said lip about the peripheral extent thereof, and a second portion covering said container open end, said cover means including an opening in said flange portion extending a predetermined portion of the periphery thereof, said flange portion being selectively engageable with said lip in any desired relative rotational orientation, whereby said opening may be placed in or out of registration with said conduit means upper end, thereby permitting or blocking communication with the vessel contents through the conduit and cover means.

2. The invention according to claim 1 wherein said cover means is selectively engageable with said lip in a rotational orientation including partial registration of said opening with said conduit means upper end.

3. The invention according to claim 1 wherein said conduit means includes a plurality of separate, closely adjacent passageways each having an open upper end separated from the upper end of an adjacent passageway by a surface area of said lip, all of said open upper ends and the surface areas by which they are separated extending about a portion of the periphery of said lip which is not greater than said predetermined portion of the periphery of said flange portion, whereby said cover means may be placed in rotational orientation with said opening in registration with said upper end of one or more of said passageways for communication therethrough with the vessel contents while sealingly engaging said lip surface area to block communication through said upper ends of others of said passageways.

4. The invention according to claims 1 or 3 wherein said conduit means comprises at least one passageway enclosed between said upper and lower ends by wall means extending along the outer surface of said container side wall.

5. The invention according to claims 1 or 3 wherein said conduit means lower end communicates with the interior of said container means through said side wall closely adjacent said bottom wall.

* * * * *